US005658066A

United States Patent [19]

Hirsch

[11] Patent Number: 5,658,066

[45] Date of Patent: Aug. 19, 1997

[54] JOINING SYSTEM FOR SECTIONAL LIGHTING ASSEMBLY

[75] Inventor: William Hirsch, Long Island City, N.Y.

[73] Assignee: Linear Lighting Corp., Long Island City, N.Y.

[21] Appl. No.: 504,586

[22] Filed: Jul. 20, 1995

[51] Int. Cl.[6] ..... F21S 3/00

[52] U.S. Cl. ..... 362/219; 362/225; 362/457

[58] Field of Search ..... 362/217, 219, 362/220, 223, 225, 368, 370, 457, 260

[56] References Cited

U.S. PATENT DOCUMENTS

| | | | |
|---|---|---|---|
| 2,383,007 | 8/1945 | Maurette | 362/219 |
| 2,434,781 | 1/1948 | Kurtzon | 362/219 |
| 2,531,232 | 11/1950 | Naysmith | 362/219 |
| 2,570,910 | 10/1951 | Berry | 362/220 |
| 2,734,995 | 2/1956 | Lenze | 362/370 |
| 2,849,595 | 8/1958 | Zurawski | 362/219 |
| 3,011,047 | 11/1961 | Spaulding | 362/219 |
| 3,299,264 | 1/1967 | Lipscomb | 362/219 |
| 3,673,402 | 6/1972 | Weiss | 362/220 |
| 4,717,993 | 1/1988 | Bernhart | 362/219 |
| 4,726,781 | 2/1988 | Bernhart et al. | 362/219 |
| 4,866,583 | 9/1989 | Targetti | 362/404 |
| 4,980,808 | 12/1990 | Lilos | 362/219 |

FOREIGN PATENT DOCUMENTS

| | | | |
|---|---|---|---|
| 2408783 | 10/1946 | Germany | 362/219 |

*Primary Examiner*—Alan Cariaso
*Attorney, Agent, or Firm*—Natter & Natter

[57] ABSTRACT

Individual fixture sections of a continuous row lighting assembly are joined together with end panels of adjacent sections abutting one another. The abutting end panels include registered apertures which carry an L-shaped fastener. Each fastener includes a first leg which engages the inner face of one end panel and a second leg having a threaded aperture which carries a screw. The screw is tightened to bear against the inner face of the other end panel to secure the fixture sections together in a continuous row.

15 Claims, 2 Drawing Sheets

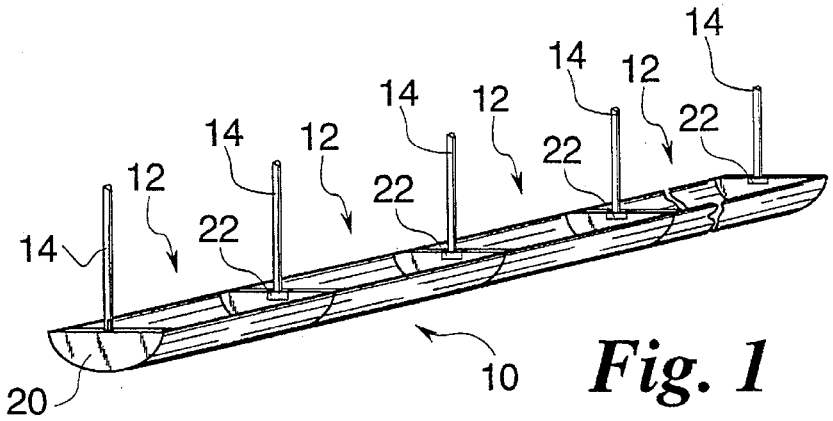
Fig. 1
Fig. 2
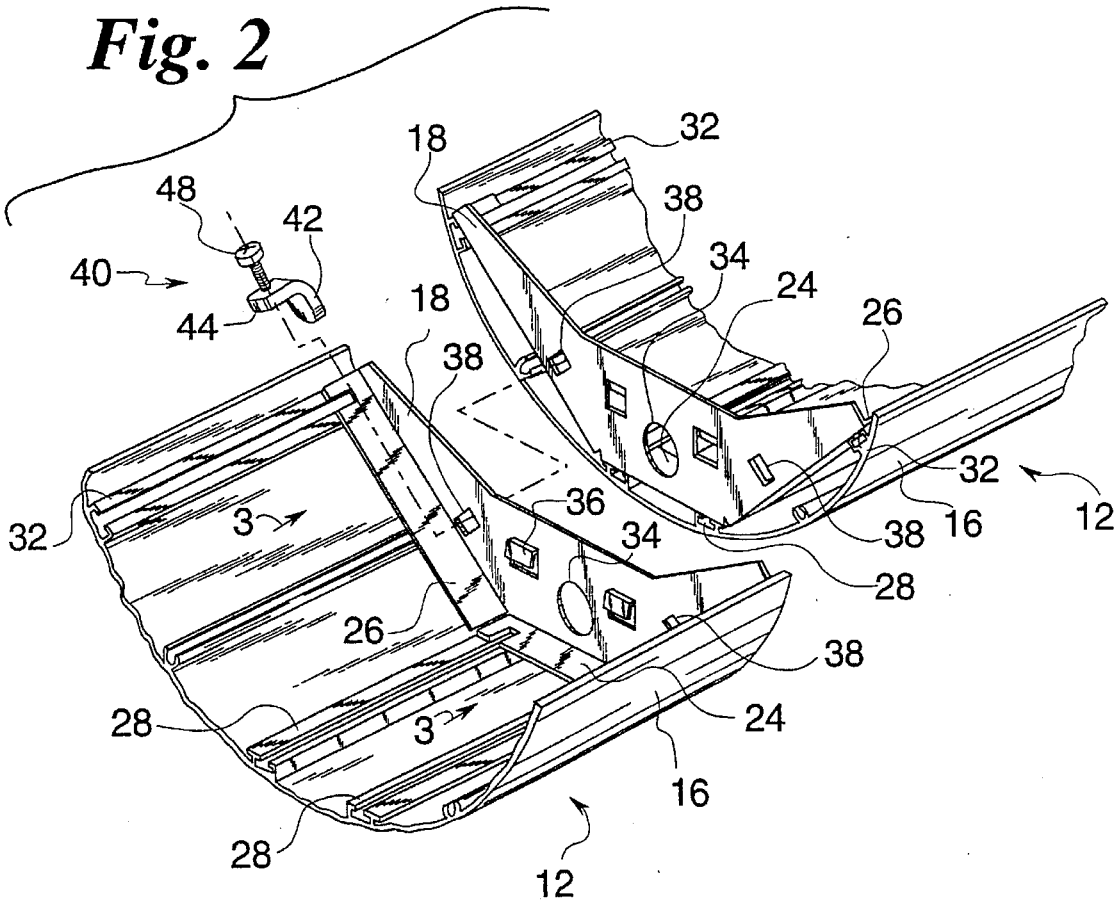

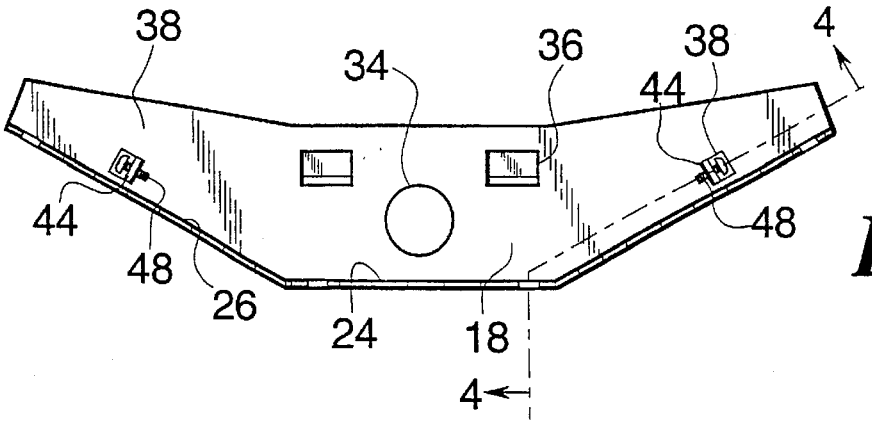
Fig.3
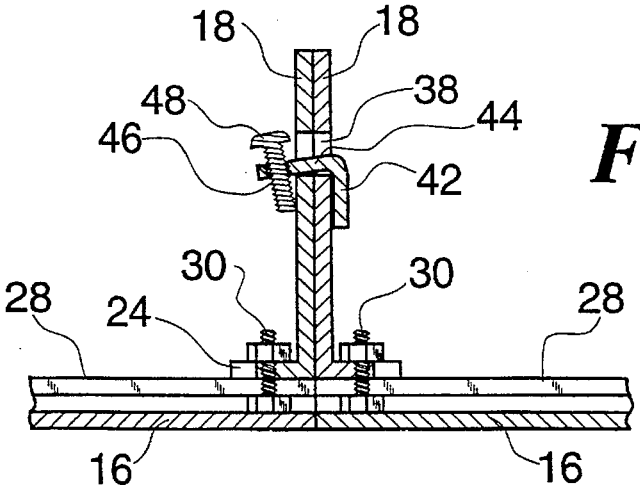
Fig. 4
Fig. 5
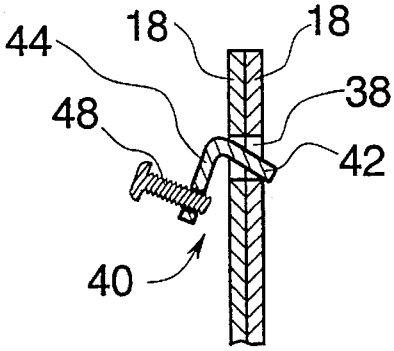
Fig. 6
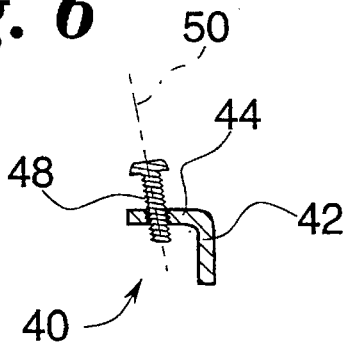

JOINING SYSTEM FOR SECTIONAL LIGHTING ASSEMBLY

BACKGROUND OF THE INVENTION

1. Field of the Invention

This invention relates generally to continuous row sectional lighting assemblies and more particularly to a system for joining abutting individual fixture sections of the lighting assembly.

2. Background Art

Many commercial lighting applications, such as schools, laboratories, electronic offices, libraries, airports, etc. utilized a continuous row of end to end connected lighting fixtures. In instances wherein fluorescent lighting fixtures were provided, the lengths of the fixture sections were determined by the lengths of the available fluorescent tubes. Most continuous row assemblies utilized fluorescent tubes of eight or four feet in length. The fixtures were generally suspended from an overhead support such as a ceiling by a plurality of hangers and were configured to transmit light radiation either upwardly, for indirect lighting, to be reflected from the ceiling, or downwardly directly on the area to be illuminated or both upwardly and downwardly in a single fixture.

Common assembly practice was to first hang the individual fixture sections at the desired height and thereafter interconnect the individual fixture sections in end to end abutting relationship to form a continuous row.

The end to end registration and joining of the individual fixture sections into the continuous row has been a labor intensive, time consuming task with laborers often standing on scaffolding or ladders. Among the factors rendering such task tedious was the fact that the individual fixture sections carried fluorescent tube chassis assemblies including tube sockets, ballasts, related wiring and mechanical components, many of which were positioned in close proximity to end panels of the fixture sections.

Assembly procedures heretofore included joining end panels of abutting fixture sections together with small bolts and machine screws, while at the same time registering the two fixtures for axial alignment and end abutment. Such tasks were often a source of frustration, especially when individual screws or nuts were dropped during the process of alignment and registration while working in the tight confines of the fixtures. Sometimes, sockets were required to be temporarily removed to join fixtures.

SUMMARY OF THE INVENTION

In compendium, the present invention comprises a joining system for a sectional lighting assembly whereby individual fixture sections are easily and permanently secured together in end abutting relationship to provide continuous row lighting.

Individual lighting fixture sections include transverse end panels. The end panels of adjacent fixtures are fastened together in face to face relationship.

A pair of L-shaped fasteners each include a first leg and a substantially perpendicular second leg having a threaded bore which carries a machine screw. The first leg of each fastener is inserted through one of a pair of registered apertures in both panels and engages the inner face of one of the end panels. Thereafter, the screw of each fastener is tightened to engage the inner face of the other end panel and secure the end panels together.

In order to assure engagement between the screw and the inner face of the other end panel, the axis of the threaded bore of the second leg intersects the plane of the first leg.

From the foregoing summary, it will be appreciated that it is an aspect of the present invention to provide a joining system for a sectional lighting assembly of the general character described which is not subject to the disadvantages of the background art aforementioned.

A feature of the present invention is to provide a joining system for a sectional lighting assembly of the general character described which is low in cost and suitable for economical mass production fabrication.

A consideration of the present invention is to provide a joining system for a sectional lighting assembly of the general character described which simplifies assembly of continuous row lighting.

To provide a joining system for a sectional lighting assembly of the general character described which reduces assembly time and labor costs is a further feature of the present invention.

Another aspect of the present invention is to provide a joining system for a sectional lighting assembly of the general character described which is readily adapted for use with lighting fixtures having limited internal clearance.

Another consideration of the present invention is to provide a joining system for a sectional lighting assembly of the general character described which results in increased labor productivity.

A further feature of the present invention is to provide a joining system for a sectional lighting assembly of the general character described wherein joining system components may be easily positioned and tightened through open tops of lighting fixture sections.

Other aspects, features and considerations of the present invention in part will be obvious and in part will be pointed out hereinafter.

With these ends in view, the present invention finds embodiment in the various combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which are shown some of the various possible exemplary embodiments of the invention:

FIG. 1 is a fragmentary perspective view of a continuous row sectional lighting assembly utilizing the joining system of the present invention;

FIG. 2 is an enlarged scale fragmentary exploded view of adjacent ends of two lighting fixture sections of the continuous row lighting assembly, with portions deleted for clarity, and showing the manner in which adjacent end panels of fixture sections are joined together through the employment of the fastener system of the present invention;

FIG. 3 is an auxiliary end elevational view of an end panel, the same being taken substantially along the plane 3—3 of FIG. 2, with portions deleted for clarity;

FIG. 4 is an enlarged scale sectional view through two abutting fixture sections, the same being taken substantially along the line 4—4 of FIG. 3 and showing the abutting fixture sections in a finished assembly format;

FIG. 5 is a fragmentary cross sectional view of abutting end panels, similar to FIG. 4, and showing the manner in which a fastener is inserted through registered apertures of the end panels; and FIG. 6 is an enlarged scale elevational view of an alternate embodiment wherein the fastener legs are perpendicular to one another and the screw extends through one of the legs along an axis skew to the plane of the other leg.

DESCRIPTION OF THE PREFERRED EMBODIMENTS

Referring now in detail to the drawings, the reference numeral 10 denotes generally a continuous row lighting assembly fabricated of a plurality of individual fixture sections 12 and supported from a ceiling (not shown) by a plurality of hangers 14. The hangers 14 may comprise wire cable or hollow tubular stems anchored to a junction box or other support mounted to the ceiling.

The individual fixture sections 14 are of a length sufficient to carry conventionally dimensioned illuminating tubes, such as standard fluorescent tubes, e.g. 8 foot, 4 foot, etc. Each fixture section 12 carries a chassis, electrical sockets and conventional circuitry, including ballasts and related wiring (not shown). In order to maximize light output, the fixture sections 12 are of a length which does not extend substantially beyond the length of the illuminating tube, e.g., 1.5 inches beyond the tube length at each end.

The fixture sections 12 include a contoured exterior shell or casing 16. In instances wherein the fixture sections are configured to project light upwardly, toward the ceiling for indirect lighting, the shell or casing 16 is opaque, while in instances wherein direct downwardly projecting illumination from the lighting tubes is desired, the shell or casing may comprise a metal frame having a translucent panel or a light diffusing or refracting grid. The configuration illustrated in the drawings depicts an assembly of typical indirect lighting fixtures.

The shell 16 may comprise an elongate extrusion having a transverse symmetrical end panel 18 mounted at each end of interior abutting fixture sections. A similar end panel (not shown) is provided at the exterior ends of the first and last fixture of the lighting assembly 10 and is covered by a decorative end plate 20. The depending end of each hanger 14 is connected to the end panels 18 by a bracket 22 which does not form part of the present invention.

The continuous row lighting assembly 10 is connected to a power supply through wires which may extend through one or more of the hanger stems, or if cable hangers are utilized, through a line cord which runs to a junction box on a course alongside one or more cables.

As will be noted from an observation of FIG. 2, the shell 16 may include a plurality of interior channels. The channels are utilized for securing the end panels 18 as well as for mounting the chassis and for mounting reflector panels, if desired.

The end panels 18 are generally planar and are mounted transverse to the longitudinal axis of the shell 16. Adjacent the bottom of each end panel 18, the panel is folded to form a generally rectangular flange 24. A pair of side flanges 26 define, at their fold line with the end panel 18, side edges of the end panel 18.

The flange 24 is seated on the upper surface of a pair of spaced bottom channels 28 of the shell 16. Each bottom channel 28 carries a bolt 30 which extends through registered open notches in the flange 24, as illustrated in FIG. 4. A head of the bolt 30 is retained in an interior portion of the bottom channel 28 and a nut compresses against the flange 24 to firmly seat and fix the end panel 18 to the shell 16.

Similarly, a bolt is positioned in each of two upper side channels 32. The side channel bolts extend through a registered notch in each side flange 26 and a nut compresses each side flange 26 against a side channel 32. The side channel 32 may be also employed for mounting reflector elements and the remaining channels of the shell 16 may be employed for mounting the fixture chassis. The end panels 18 may also include a wiring aperture 34 and a pair of partially stamped out sections 36, for engagement with the hanging bracket 22.

The plane of the outer face of the end panel 18 is registered with the plane of the end edge of the shell 16 as will be noted from an observation of FIGS. 2 and 4.

In order to join the individual fixture sections 12 in registered end abutting relationship to complete the fabrication of the continuous row lighting assembly 10, it is necessary to secure abutting end panels 18 together.

In accordance with the invention, a pair of symmetrically disposed apertures 38 are provided in the end panels 18 adjacent the side flanges 26. Within each of the apertures 38, an L-shaped fastener 40 is seated. The fastener 40 is preferably formed of unitary, one piece construction of metal, e.g. steel, and comprises a first, generally planar leg 42 and a second, generally planar leg 44 oriented at a slightly acute angle, e.g. 88 degrees, relative to the first leg. The second leg 44 includes a threaded bore 46 carrying a matingly threaded machine screw 48.

To secure the end panels 18 together, the fastener 40, carrying the screw 48 in a backed off position (as illustrated in FIG. 5), is tilted to an acute angle relative to the end panels 18 and the first leg 42 is inserted through mating registered apertures 38 of both end panels. Thereafter, the fastener 40 is slid downwardly and pivoted about the bottom of the registered apertures 38 until the inner face of the first leg 42 abuts the inner face of the right (as shown in FIG. 4) end panel 18. Thereafter, the screw 48 is tightened. Alternately, the screw is tightened to draw the inner face of the first leg 42 against the inner face of the panel.

As will be noted from an examination of FIG. 3, the apertures 38 are strategically positioned adjacent the side edges of the end panels. The apertures 38 are easily accessible from the open top of each fixture section 12 and are not adjacent the centrally located chassis and electrical sockets. Thus, the fasteners 40 may be inserted through the apertures and the screws 48 tightened without difficulty.

Because the first and second legs 42, 44, respectively, are oriented at an acute angle toward one another, tightening down on the screw 48 causes the bottom side edge of the screw to bear against the inner face of the left end panel (as shown in FIG. 4) to bring and fix the two end panels, hence the two adjacent fixture sections, together in abutting relationship.

It should be noted that both fasteners 40 may be inserted through the registered apertures 38 from the same end panel (FIG. 3) or one may be inserted from the right end panel and the other, from the left end panel.

In FIG. 6, an alternate embodiment of the fastener 40 is illustrated. In this embodiment, the first and second legs 42, 44 are perpendicular to one another however, the threaded aperture extending through the second leg 44 lies on an axis 50 which is not perpendicular to the plane of the second leg and intersects the plane of the first leg 42. As a result, when the screw 48 is turned down, it will engage the inner surface of an end panel in substantially the same manner as the screw of the fastener previously described.

Thus it will be seen that there is provided a joining system for a continuous row lighting assembly which achieves the various aspects, features and considerations of the present invention and which is well suited to meet the conditions of practical use.

Since various possible embodiments might be made of the present invention and various changes might be made in the exemplary embodiments set forth herein without departing from the spirit thereof, it is to be understood that all matter herein described or shown in the accompanying drawings is to be interpreted as illustrative and not in a limiting sense.

Having thus described the invention, there is claimed as new and desired to be secured by Letters Patent:

1. A system for joining lighting fixture sections of a continuous row lighting assembly, each lighting fixture section including an end panel having an interior face and an exterior face, the exterior faces of end panels of adjacent fixture sections being in abutment against each other, the system for joining comprising fastener means, the fastener means including a generally planar first leg and a generally planar second leg, means for rigidly interconnecting the first leg and the second leg, means forming a threaded bore through the second leg, the threaded bore extending along an axis, the fastener means further including screw means, the screw means being engaged in the threaded bore, the axis of the threaded bore intersecting the plane of the first leg, whereby the first leg may be positioned against the interior face of one of the abutting end panels and the screw means tightened to exert compressive force on the interior face of the other end panel to join the adjacent fixture sections together.

2. A system for joining lighting fixture sections as constructed in accordance with claim 1 wherein the first leg and the second leg of the fastener means are joined in a generally L-shaped configuration.

3. A system for joining lighting fixture sections as constructed in accordance with claim 2 wherein the first leg and the second leg are perpendicular to one another.

4. A system for joining lighting fixture sections as constructed in accordance with claim 2 wherein the first leg and the second leg are joined at an acute angle.

5. A system for joining lighting fixture sections in accordance with claim 1 wherein each end panel includes at least one aperture, the apertures in the abutting end panels being in registration, the first leg of the fastener means having a maximum transverse dimension less than the minimum transverse dimension of the registered apertures, whereby the first leg may be inserted through the registered apertures and positioned against the interior face of one of the abutting end panels and the adjacent lighting fixture sections joined together by tightening the screw means against the interior face of the other end panel.

6. A continuous row lighting assembly, the assembly comprising a plurality of abutting lighting fixture sections, each lighting fixture section including an end panel having an interior face and an exterior face, the exterior faces of end panels of adjacent fixtures being in abutment against each other, the assembly further comprising fastener means, the fastener means including a generally planar first leg and a generally planar second leg and means for rigidly interconnecting the first and second legs, the second leg including a threaded bore therethrough and screw means engaged in the threaded bore, the threaded bore extending along an axis, the axis of the threaded bore intersecting the plane of the first leg, the first leg being positioned against the interior face of one of the abutting panels with the screw means being tightened against the interior face of the other abutting end panel to secure the panels together.

7. A continuous row lighting assembly as constructed in accordance with claim 6 wherein the first leg and the second leg of the fastener means are joined in a generally L-shaped configuration.

8. A continuous row lighting assembly as constructed in accordance with claim 7 wherein the first leg and the second leg are perpendicular to one another.

9. A continuous row lighting assembly as constructed in accordance with claim 7 wherein the first leg and the second leg are joined at an acute angle.

10. A continuous row lighting assembly as constructed in accordance with claim 6 wherein each end panel includes at least one aperture, the at least one aperture in the abutting end panels being in registration, the first leg of the fastener means having a maximum transverse dimension less than the minimum transverse dimension of the registered apertures, whereby the first leg may be inserted through the registered apertures and positioned against the interior face of one of the abutting end panels and the adjacent lighting fixture sections joined together by tightening the screw means against the interior face of the other end panel.

11. A method of assembling a continuous row lighting system, the method including the steps of:

(a) providing a plurality of lighting fixture sections, with each lighting fixture section including an end panel, (b) registering the end panels of adjacent lighting fixture sections in face to face abutting relationship, (c) providing a fastener comprising a first leg and a second leg and means rigidly interconnecting the legs and with the second leg having a threaded bore carrying a screw, (d) positioning the first leg of the fastener against an interior face of one abutting end panel, and (e) tightening the screw to bear down against an interior face of the other end panel.

12. A method of assembling a continuous row lighting system in accordance with claim 11 including the steps of providing a further fastener, positioning the first leg of the further fastener against an interior face of a first end panel and tightening the screw of the further fastener to bear down against the interior face of a second end panel.

13. A method of assembling a continuous row lighting system in accordance with claim 12 wherein the first end panel is the one end panel and the second end panel is the other end panel.

14. A method of assembling a continuous row lighting system in accordance with claim 11 wherein the end panels are provided with apertures, the step of registering the end panels including the step of registering the apertures of abutting end panels, the step of positioning including inserting the first leg of the fastener through the registered apertures and pivoting the fastener about the end panels.

15. A method of assembling a continuous row lighting system with the system for joining lighting fixture sections constructed in accordance with claim 1, the method comprising the steps of:

(a) providing the plurality of lighting fixture sections, (b) registering the end panels of adjacent lighting fixture sections in face to face abutting relationship, (c) positioning the first leg of the fastener means against an interior face of one abutting end panel, and (d) tightening the screw means to bear down against the interior face of the other end panel.

* * * * *